United States Patent [19]

Thiele et al.

[11] 4,282,664

[45] Aug. 11, 1981

[54] DIPPER DOOR RETAINER

[75] Inventors: Arthur M. Thiele, Park Forest; Herman A. Fabert, Jr., Homewood, both of Ill.

[73] Assignee: Abex Corporation, New York, N.Y.

[21] Appl. No.: 130,885

[22] Filed: Mar. 17, 1980

[51] Int. Cl.[3] ..... E02F 3/46; E02F 3/81

[52] U.S. Cl. ..... 37/118 R; 414/726

[58] Field of Search ..... 37/115–118 R, 37/103, 141 R, DIG. 2; 414/694, 704, 725, 726

[56] References Cited

U.S. PATENT DOCUMENTS

| | | | |
|---|---|---|---|
| 2,335,352 | 11/1943 | Murtaugh | 414/726 |
| 2,561,518 | 7/1951 | Larsen | 414/726 X |
| 2,735,559 | 2/1956 | Burdick et al. | 37/118 R |
| 2,788,907 | 4/1957 | Larsen | 37/118 R |
| 2,861,704 | 11/1958 | Kluckhohn | 414/726 X |
| 3,059,793 | 10/1962 | Atkinson et al. | 414/726 |
| 3,219,214 | 11/1965 | Baer | 37/118 R |
| 3,767,070 | 10/1973 | Arnold | 414/726 |

*Primary Examiner*—E. H. Eickholt

*Attorney, Agent, or Firm*—Thomas S. Baker, Jr.; David A. Greenlee

[57] ABSTRACT

A multi-part fastening device which pivotally connects a door to a dipper and the dipper to a power shovel handle about the same axis, wherein one part of the device can be removed to permit the dipper to be removed from the handle, while the other part of the device remains in place to retain the door on the dipper.

4 Claims, 3 Drawing Figures

FIG. 2
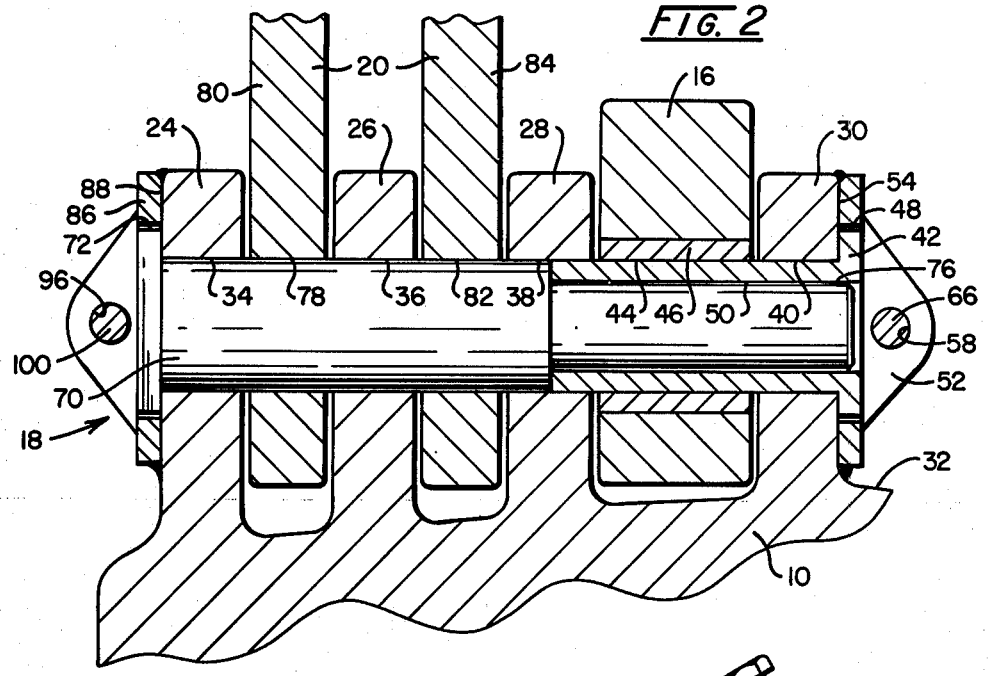
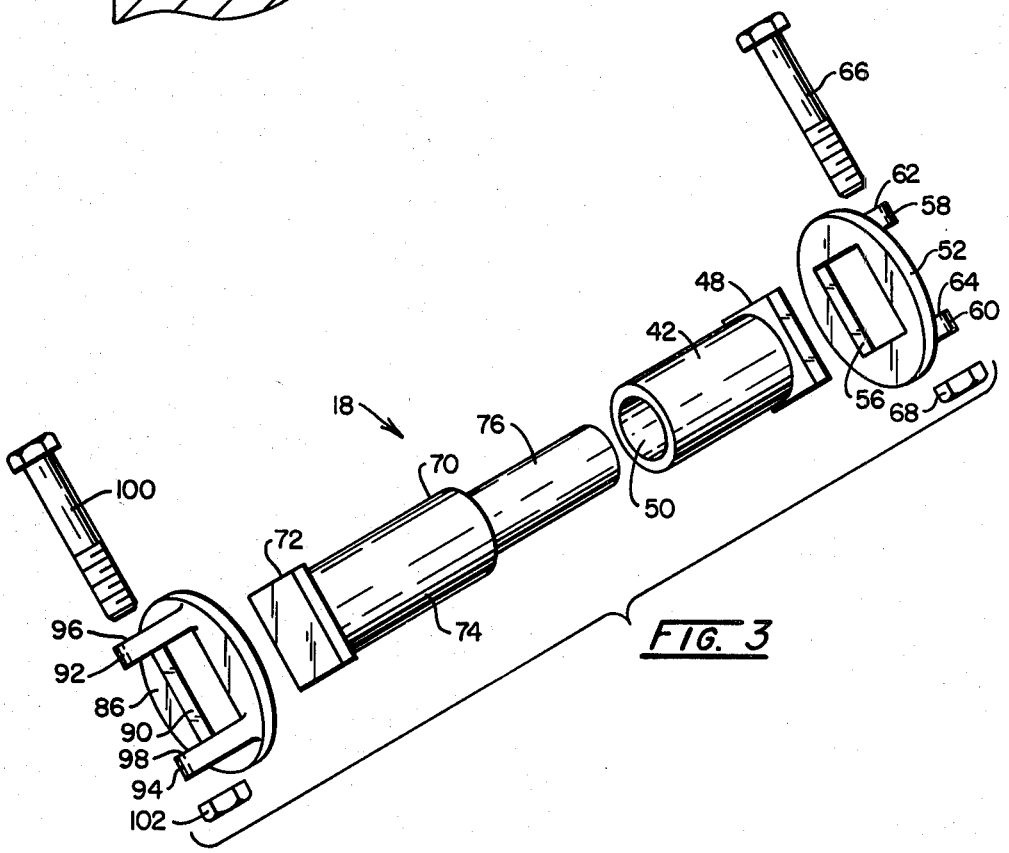
FIG. 3

DIPPER DOOR RETAINER

BACKGROUND OF THE INVENTION

1. Field of the Invention

This invention relates to a power shovel dipper or bucket which has a fastening device which pivotally connects a door to the dipper and the dipper to a handle about a common axis.

2. Description of the Prior Art

A dipper is commonly used on a power shovel or other power source excavating device for the purpose of moving earth, rock or ore. Among its many applications are mining, quarrying, road building and maintenance, building excavating, digging trenches or pipelines, etc. Dippers used on power shovels commonly have an open front for receiving material and a door which is pivotally attached to the back of the dipper for discharging material. The dipper is pivotally attached to one end of a handle which, in turn, is secured to the power shovel boom.

On some dippers, the pivot axis for the connection of the door to the dipper is the same as the pivot axis for the connection of the dipper to the handle. This permits the use of a common fastening device to pivotally attach the door to the dipper and the dipper to the handle.

Dippers are subjected to a great deal of impact, abrasion and wear. Consequently, many of the components of a dipper, such as the front casting, heel band and door, are designed to be rebuilt or replaced. In order to repair a dipper, it must be removed from the machine to which it is attached so that it can be transported to a repair facility. In order to remove the dipper from its handle, the fastening device, which is commonly a pin, is removed. If the same pin is also used to pivotally connect the door to the dipper, the door will become detached from the dipper.

It is desirable to retain the door on the dipper after the dipper is removed from its handle so that the dipper and door can be transported as a unitary structure. If the door is separated from the dipper, it requires special handling and large doors may have to be transported on a truch separate from the one transporting the dipper.

To avoid having to separately handle and transport the dipper and the door where a common fastening device mounts the door on the dipper and the dipper on the power shovel handle, it is common practice to weld the door to the dipper before the fastening device is removed. After the dipper has been repaired, it is again connected to the handle by the fastening device, which also connects the door to the dipper. Subsequent to the re-installation of the device, the welds which connect the door to the dipper are ground off to restore the door to its operating condition.

It is desirable to provide a fastening device for pivotally connecting the door to the dipper and the dipper to the handle which permits the dipper to be separated from the handle without detaching the door from the dipper.

SUMMARY OF THE INVENTION

The instant invention provides a multi-part fastening device which pivotally connects a door to a dipper and the dipper to a handle about the same axis, wherein one part of the device can be removed to permit the dipper to be removed from the handle, while the other part of the device remains in place to retain the door on the dipper.

DESCRIPTION OF THE DRAWINGS

FIG. 2 is an enlarged view along line 2—2 of FIG. 1 showing one half of the top of the dipper and one of the fastening devices; and FIG. 3 is an exploded view of the fastening device of FIG. 2.

DESCRIPTION OF THE PREFERRED EMBODIMENT

Figure 1:
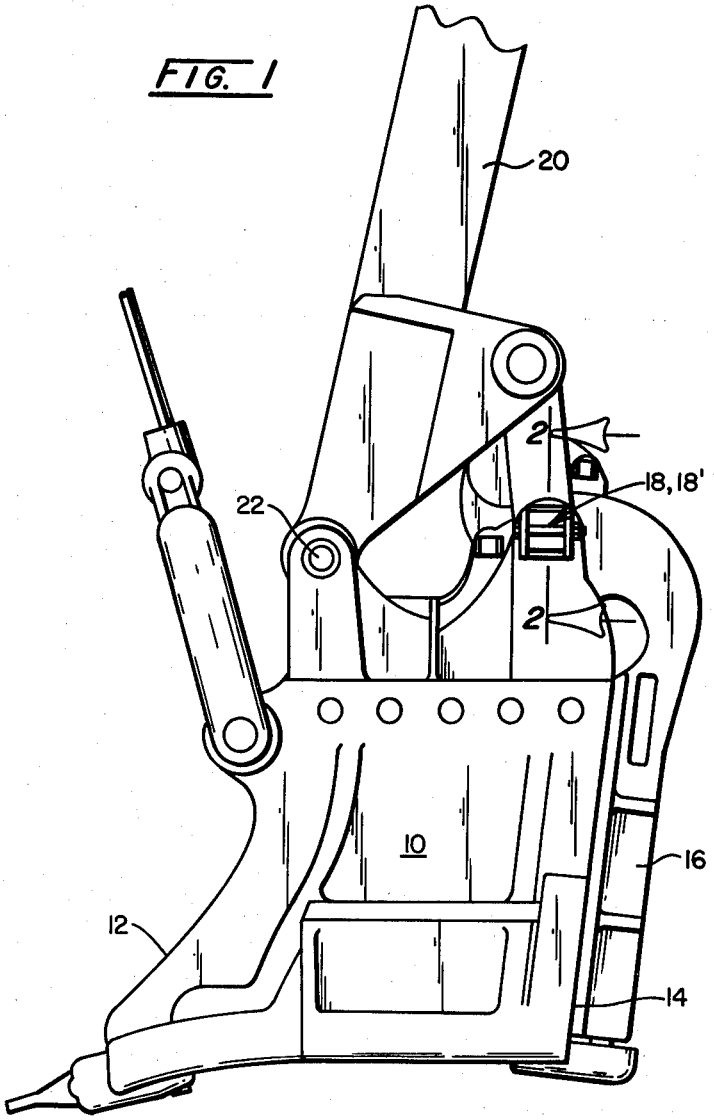
FIG. 1 is a side view of a dipper showing one end of one of the devices which pivotally connect the dipper to the handle and the door to the dipper about a common axis.

Referring to FIG. 1 of the drawings, a dipper 10 is shown which has an open front 12 and a back 14 which is closed by a door 16. The door 16 is pivotally attached to the top of dipper 10 by a pair of fastening devices 18, 18' described in detail hereinafter. Dipper 10 is pivotally connected to one end of a power shovel handle 20 at one location about the same axis that door 16 is connected to the dipper 10 by the pair of fastening devices 18, 18' and at another location by a pivot pin 22.

The pivotal connection of door 16 to dipper 10 and of dipper 10 to handle 20 can be seen by referring to FIG. 2, which is a view of one half of the top of dipper 10 and shows one of the two identical fastening devices 18, 18', and to FIG. 3 which is an exploded view of the fastening device 18. Although FIG. 2 is a view of only one half of the top of dipper 10 and shows only one fastening device 18, and this description refers only to that structure shown in FIG. 2, it should be remembered that the description also applies to a structure which is a mirror image of that shown in FIG. 2 and to the second fastening device 18' mounted on the other half of the top of dipper 10.

Four upstanding ears 24, 26, 28, 30 project from the top surface 32 of dipper 10 and a lateral bore 34, 36, 38, 40 is formed in each of the ears 24, 26, 28, 30, respectively. Door 16 is pivotally attached to dipper 10 by a cylindrical sleeve pin 42 which is one part of fastening device 18. Pin 42 passes through bore 40 in ear 30, an inner bore 44 of a bushing 46 mounted in door 16 and partially engages bore 38 in ear 28. The sleeve pin 42 has a square head 48 and an inner bore 50. It is retained in position by a sleeve pin retainer 52 which is welded to one lateral surface 54 of ear 30. The sleeve pin retainer 52 has a square opening 56 which is sized large enough to permit the head 48 of pin 42 to pass therethrough, but small enough to prevent rotation of the head 48. The sleeve pin retainer 52 has a pair of lateral ears 58, 60, each of which has a bore 62, 64, respectively, formed therein. A bolt 66 passes through ear bores 62, 64 and is secured by a nut 68. The bolt 66 prevents sleeve pin 42 from moving laterally. Consequently, with the sleeve pin 42 part of fastening device 18 in place, door 16 is mounted on dipper 10.

Dipper 10 is pivotally attached to power shovel handle 20 by a solid handle pin 70 which is another part of fastening device 18. The pin 70 has a square head 72, an enlarged portion 74 adjacent head 72 and a reduced diameter portion 76 adjacent the enlarged portion 74. The handle pin 70 pivotally connects dipper 10 to handle 20 by having enlarged portion 74 engage bore 34 of ear 24, a bore 78 of a flange 80 on handle 20, bore 36 of ear 26, a bore 82 of a flange 84 on handle 20 and a portion of bore 28 of ear 38, respectively. The reduced diameter portion 76 of handle pin 70 is received in the inner bore 50 of sleeve pin 42 to provide additional strength of the fastening device 18.

Handle pin 70 is retained in position by a handle pin retainer 86 which is welded on a lateral surface 88 of ear 24. Handle pin retainer 86 is identical to sleeve pin retainer 52. The pin retainer 86 has a square opening 90 which is sized large enough to receive head 72 of pin 70 but small enough to prevent rotation of the head 72. The pin retainer 86 also has a pair of lateral ears 92, 94, each of which has a bore 96, 98. A bolt 100 passes through the ear bores 96, 98 and is secured by a nut 102 to thereby prevent lateral movement of the pin 70.

From the above it can be seen that door 16 pivots with respect to dipper 10 about the same axis that dipper 10 pivots about handle 20 and a two-part fastening device 18 connects the door 16 to the dipper 10 and the dipper 10 to the handle 20. In order to remove dipper 10 from handle 20, nut 102 is removed from bolt 100 and bolt 100 is removed from ear bores 96, 98 to permit axial movement of handle pin 70. Subsequently, handle pin 70 is withdrawn from bore 50 of sleeve pin 42, bore 38 of ear 28, bore 82 of flange 84, bore 36 of ear 26, bore 78 of flange 80 and bore 34 of ear 24, respectively, to thereby disconnect dipper 10 from handle 20. Although pin 70 is removed and dipper 10 is disconnected from handle 20, door 16 remains pivotally connected to dipper 10 by sleeve pin 42.

Door 16 can be removed from dipper 10 while dipper 10 remains connected to handle 20. Nut 68 is removed from bolt 66 and bolt 66 is withdrawn to permit axial movement of sleeve pin 42. Subsequently, sleeve pin 42 is withdrawn from bore 38 of ear 28, bore 44 of door bushing 46 and bore 40 of ear 30, respectively. Despite the removal of pin 42 and door 16, dipper 10 remains pivotally connected to handle 20 by handle pin 70. Thus, either door 16 can be removed from dipper 10 or dipper 10 can be removed from power shovel handle 20 independently of the other.

Obviously, those skilled in the art may make various changes in the details and arrangements of parts without departing from the spirit and scope of the invention as it is defined by the claims hereto appended. Applicants, therefore, wish not to be restricted to the precise construction herein disclosed.

We claim:

1. A fastening device for pivotally attaching a power shovel dipper to a power shovel handle and for pivotally attaching a door to the dipper, characterized by a first member of the fastening device, the first member pivotally attaching the dipper to the handle about a horizontal axis, a second member of the fastening device, the second member pivotally attaching the door to the dipper about said axis, wherein the first member can be removed independently of the second member to permit the dipper to be removed from the handle independent of the removal of the door from the dipper.

2. The fastening device of claim 1, further characterized by one of the first or second members including a sleeve portion, the sleeve portion having a bore formed therein and the other of the first or second members having a reduced diameter portion and the reduced diameter portion is received in the sleeve bore.

3. The fastening device of claim 1, further characterized by a retainer means mounted on the dipper for preventing axial movement of the first member.

4. The fastening device of claim 3, further characterized by a head formed on the first member, the retainer means includes means for preventing rotation of the first member and said rotation preventing means engages the head of the first member.

* * * * *